US005454561A

United States Patent [19]

Smith

[11] Patent Number: 5,454,561

[45] Date of Patent: Oct. 3, 1995

[54] TETHERED BASEBALL BATTING PRACTICE APPARATUS

[76] Inventor: Christopher L. Smith, 1119 Elm, Norman, Okla. 73069

[21] Appl. No.: 247,158

[22] Filed: May 20, 1994

[51] Int. Cl.[6] ..... A63B 69/40

[52] U.S. Cl. ..... 273/26 E; 273/29 A; 273/413; 273/184 B

[58] Field of Search ..... 273/26 E, 27 A, 273/58 C, 185 C, 185 D, 184 B, 197 R, 196, 197 A, 200 R, 200 B, 206, 413

[56] References Cited

U.S. PATENT DOCUMENTS

| | | | |
|---|---|---|---|
| 2,976,040 | 3/1961 | Bales | 273/26 E |
| 3,118,670 | 1/1964 | Smith | 273/26 E |
| 3,406,571 | 10/1968 | Hackey | 273/185 D |
| 3,815,922 | 6/1974 | Brainard | 273/184 B |
| 4,793,612 | 12/1988 | Hammond | 273/26 E |
| 5,121,923 | 6/1992 | Allura | 273/197 A |
| 5,137,549 | 7/1992 | Vasquez | 273/26 E |
| 5,178,393 | 1/1993 | Dennisen . | |
| 5,255,920 | 10/1993 | Mangeri | 273/185 C |
| 5,271,618 | 12/1993 | Malwitz | 273/26 E |

*Primary Examiner*—Theatrice Brown
*Attorney, Agent, or Firm*—Robert K. Rhea

[57] ABSTRACT

A tethered ball for practice batting and increasing the distance a ball player is capable of batting a ball is provided by a standard vertically adjustably supporting, at its upper end portion, a laterally projecting arm journaling a hub supporting one end of a flexible strand having a ball secured to its other end. A sensor in the horizontal arm, responsive to the number of revolutions of the hub in response to a bat hitting the ball is connected with a circuit contained by the horizontal arm and an LCD housing mounted display on the arm for indicating the equivalent distance of ball flight in response to the magintude of force applied to the ball.

4 Claims, 3 Drawing Sheets

TETHERED BASEBALL BATTING PRACTICE APPARATUS

BACKGROUND OF THE INVENTION

1. Field of the Invention

This invention relates to the game of baseball or softball and more particularly to an apparatus permitting players to practice batting a ball.

2. Description of the Prior Art

I do not know of any patent that discloses a ball batting practice apparatus, such as is disclosed by this invention.

SUMMARY OF THE INVENTION

A base vertically supports a standard inturn supporting a vertically adjustable horizontal arm.

The end portion of the arm remote from the standard supports an angularly rotatable hub supporting one end of a flexible strand having its other end secured to a ball or softball describing a circular arc around the horizontal axis of the arm when struck by a ball bat.

The number of revolutions of the ball and hub around the longitudinal axis of the arm is in direct relation to the magnitude of force imparted to the ball by the baseball bat. An electronic circuit supported by the arm includes a sensor responsive to the number of revolutions of the rotating hub around the horizontal axis of the arm which is translated to units of measurement representing baseball flight distance visually displayed by LCD's supported by a housing mounted on the arm.

The principal objects of this invention are to provide a tethered ball batting practice apparatus providing a visual record in equivalent distance measurements and number of hits of a ball for developing proficiency in batting and which allows the user to determine which bat weight results in the greatest distance measurements.

DESCRIPTION OF THE PREFERRED EMBODIMENTS

Like characters of reference designate like parts in those figures of the drawings in which they occur.

Figure 1:
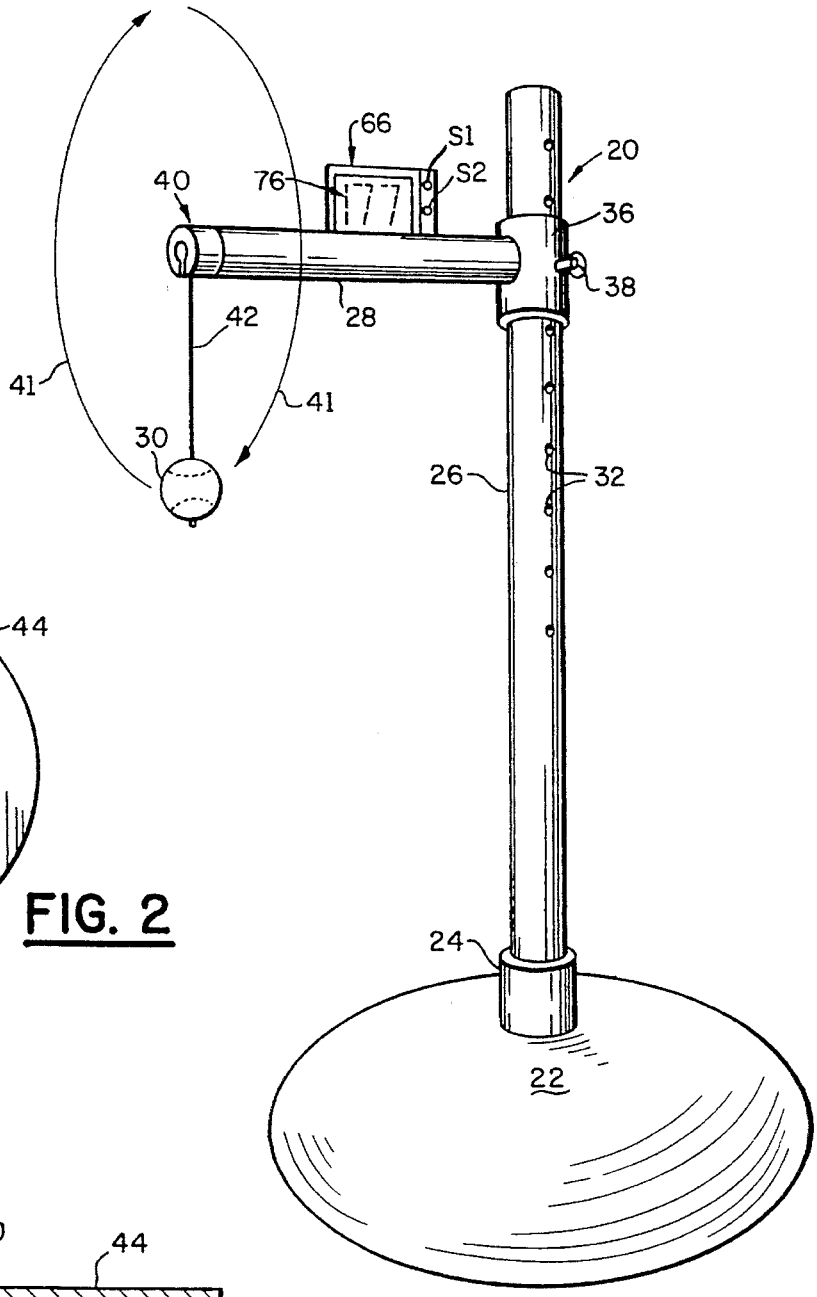
FIG. 1 is a perspective view of the apparatus.

Referring first to FIG. 1 the reference numeral 20 indicates the device as a whole which is upright post-like in general configuration.

The device 20 comprises a base 22 having an upwardly open socket 24 centrally supporting, a preferably tubular, standard having a laterally projecting arm 28 inturn supporting a tethered ball 30 at its end remote from the standard.

The base 22 is dome-like in the example shown but obviously may be any suitable member capable of maintaining the standard 26 upright. The depending end portion of the standard is telescopically received by the base socket 24.

The upper end portion of the standard 26 is provided with a vertical series of equally spaced apart apertures 32 extending horizontally through its wall.

One end of the horizontal arm 28 is rigidly secured to an arm sleeve 36 vertically slideably surrounding the standard 26 and transversely apertured for receiving a pin 38 entering a selected aperture 32 and positioning the arm 28 at a desired elevation with respect to the base.

Figure 2:
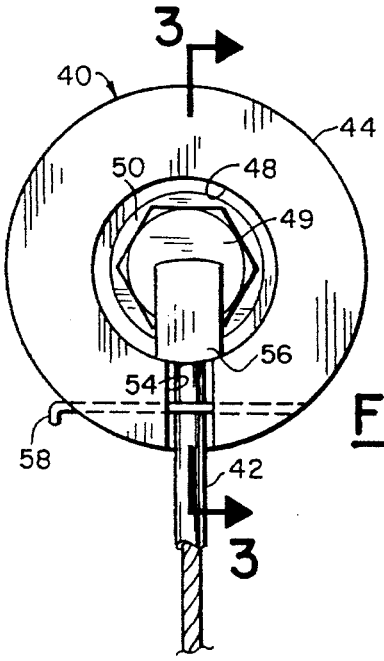
FIG. 2 is an elevational view, to a larger scale, of the arm hub end opposite the standard.
Figure 3:
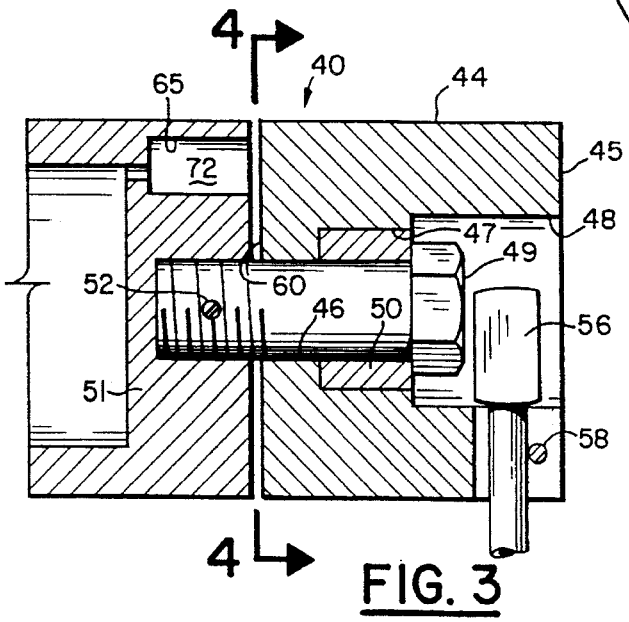
FIG. 3 is a fragmentary vertical cross section taken substantially along the line 3—3 of FIG. 2.
Figure 4:
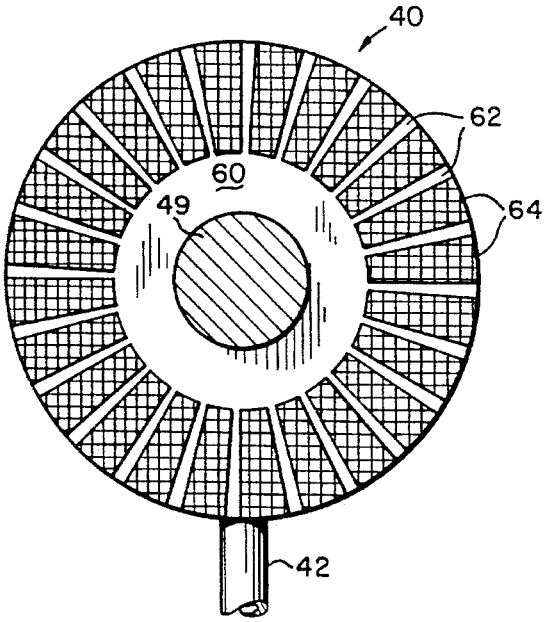
FIG. 4 is an elevational view, to a further enlarged scale partly in section, looking in the direction of the arrows 4—4 of FIG. 3; and, FIGS. 5A, 5B and 5C are circuit diagrams.
Figure 5A:
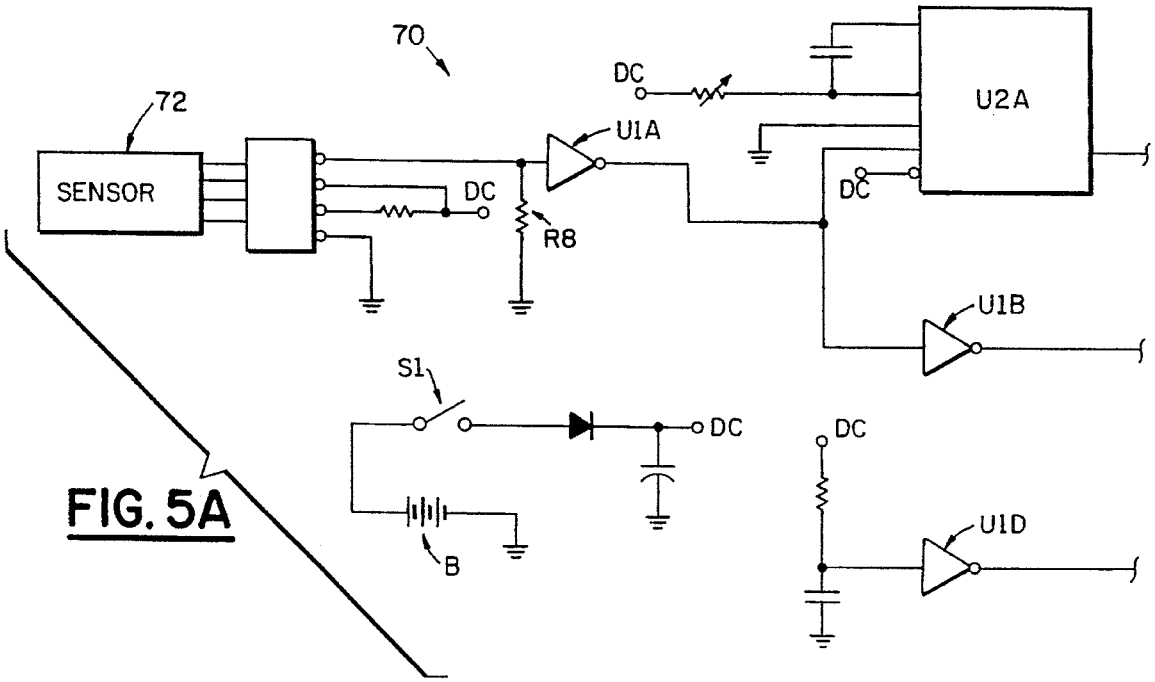
Figure 5B:
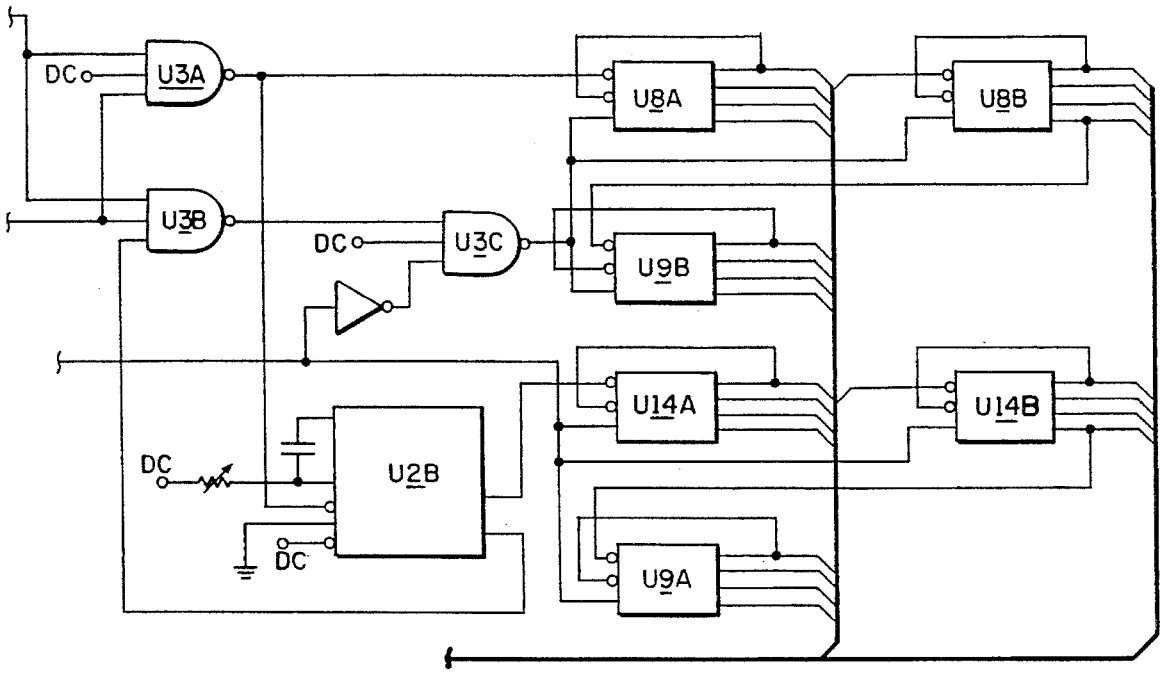
Figure 5C:
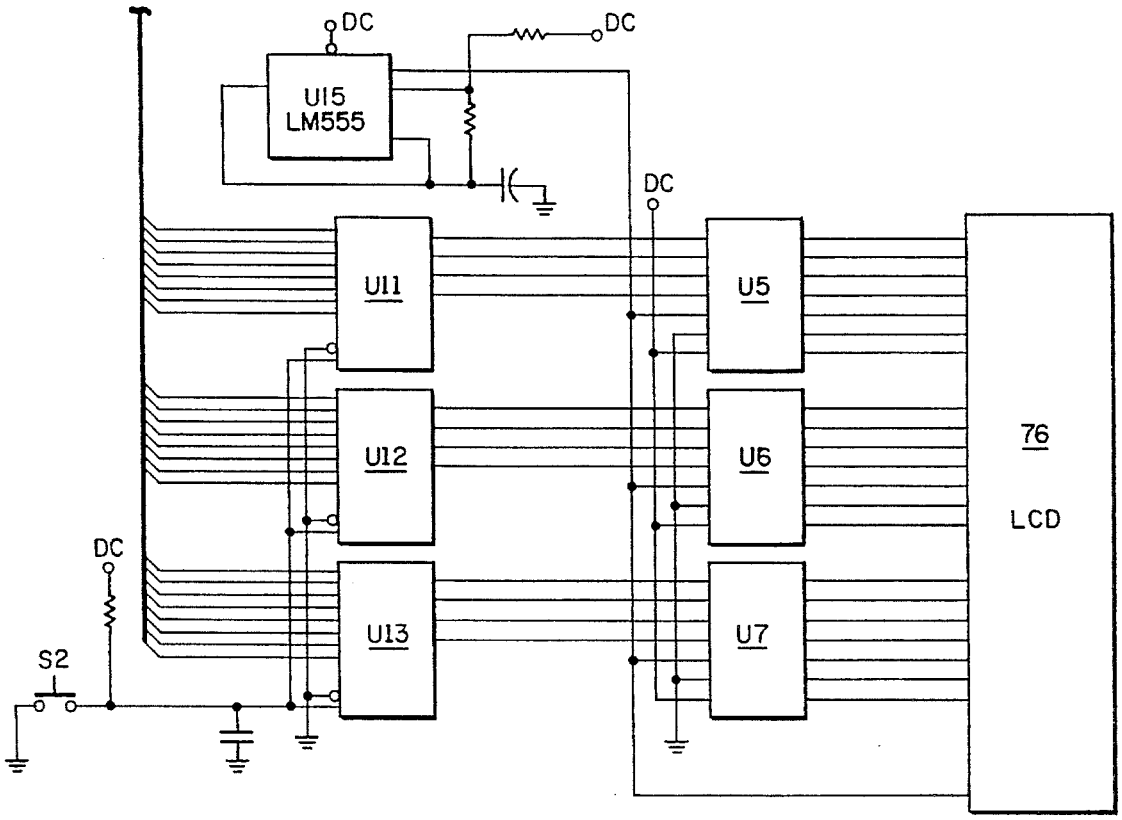

Referring also to FIGS. 2–4 angularly rotatable hub means 40, at the end of the arm 28 remote from the standard 26, secures one end portion of a flexible strand 42 secured at its other end portion to the ball 30. The hub means 40 comprises a right circular cylinder 44 bored and counterbored from its end 45 as at 46, 47, and 48 for respectively a receiving a stud bolt 49 and a bearing 50 journaling the cylinder 44. The adjacent end wall 51 of the arm 28 is bored and threaded for receiving the stud bolt 49. The end wall 51 and the stud bolt are diametrically line drilled to receive a lock pin 52 for the reasons believed obvious.

The wall defining the counterbore 48 is radially slotted, as at 54, for receiving the ball tether strand 42 and its strand lug 56. The strand being maintained within the slot 54 by a cotter pin 58.

The outer peripheral portion of the cylinder right circular end face 60 facing the arm end wall 51 is provided with an endless series of truncated isosceles triangular shaped light and dark areas 62 and 64, respectively, radially disposed in juxtaposed relation for the purpose presently explained. By way of example, the light areas are preferably white and the dark areas are preferably black. The arm end wall 51 is provided with a recess 65 adjacent its periphery facing the hub end surface 60, for the reasons presently explained.

When the ball 30 is struck by a bat, not shown, the ball rotates in a circular direction in a substantially vertical plane, indicated by the arrows 41, normal to the longitudinal axis of the arm 28.

Refering also to the remaining Figs. the reference numeral 70 indicates an electronic circuit comprising a plurality of known components, such as ICU's, herein indicated by the letter U followed by a numeral and/or letter, connecting a light sensor 72 with LED indicia 76 supported by a housing 66 mounted on the arm 28.

The circuit 70 is energized by a source of direct current such as a battery or batteries B supplying DC to the several components of the circuit through an off/on switch S1 on the housing 66.

The reflective light sensor 72 (OMRON EE-SB5) contains infrared LED and a photo transistor. The white segments or areas on the hub surface 60 while rotating, reflects the infrared light of the emitter to the photo transistor. This reflected energy cause the to transistor to conduct an amount of current sufficient to produce a detectable voltage change across a resistor R8. The dark areas or segments 64 on the hub surface 60 reflect very little energy generating a very small current (digital low voltage signal) conducted by the photo transistor.

The voltage change across the resistor R8 is the input to a Schmitt trigger inverter U1A. The inverter U1A cleans the signal from an analog to a useable digital representation and as the hub 40 spins the output of the Scmitt trigger U1A is a pulse train of digital high and low pulses. The pulse signal transitions from high to low and back to high increase in direct relation with the increase in speed of the hub.

When the hub slows in rotation as the ball's energy is depleted the pulses become increasingly spaced-apart. When the ball 30 is at rest, either a fixed high or a low signal is the output from the trigger inverter U1A.

Pulses are initiated when the ball 30 is struck by a bat. The first rising edge of pulse low to high transition of the signal causes U2A (a one shot) to trigger. The function of U2A is to provide a fixed time window within which at least two pulse rising edges must occur. This allows the circuit to stop counting when the ball slows beyond the threshold spin rate.

For example, the ball will eventually slow to a point where it fails to complete a full revolution and enters a pendulum state and decays its swing. This decaying action would accumulate undesirable counts. Therefore U2A's window function allows the circuit to filter out this action and display a number from the first part of the ball hit characteristics in which the signal will transition into a falling edge becoming a digital low signal.

The low signal in conjunction with U2A being triggered and U2B (also a retriggerable one shot) having its output connected with three distance decade counters U8A, U8B, and U9B not being triggered causes the counters to zero.

The next rising signal edge causes U2B to retrigger and remain triggered until the ball comes to a complete stop. This event will only occur once per hit of the ball and the U2B output is used to count the number of hits. Logic circuits U3A, U3B, and U2B time out prevent the distance decade counters U8A, U8B, and U9B from being zeroed out following the turn off of U2A.

Pulses within the time window of U2A are counted on the three distance decade counters U8A, U8B, and U9B. The count accumulated with each black to white transition continues until the period (time from the edge of one light area to the edge of the next light area) becomes greater than the time out of U2A. Pulses greater than this time out period are ignored since U2A's output must be "on" to allow pulses to pass. When the pulses are longer than the time out period, U2A will be "off" and the pulse will not pass through U3A.

The total number of light areas 62 on the hub surface 60 representing each revolution of the hub is adusted in accordance with the number of hub revolutions of each hit (via the time out of U2A) to equal an equivalent distance count of a ball hit. The next hit on the ball 30 starts a new cycle.

The number of ball hit counts accumulated in the decade counters U14A, U14B, and U9A are connected to multiplexers U11, U12, and U13 which normally route the distance count to the decade to seven segment displays U5, U6, and U7. Closing a push button switch S2 on the housing 66 allows the hit count signals from the decade counters U14A, U14B, and U9A to pass through the multiplexers U11, U12, and U13 to the decade to seven segment LCD display U5, U6, U7 and LCD 76 for visual observation by the operator.

A U15 and timer LM555 provide the LCD back plane signal a square wave output at a selected value, for example, 200 Hz.

The decade to seven segment display U5, U6, and U7 in combination with the back plane signal of the timer LM555 provide the phased pulses necessary to drive the LCD.

OPERATION

Operation seems obvious in that the operator energizes the circuit by closing the switch S1 and hits the ball 30 with a bat, not shown, and after each decay of the ball pendulum swing, which may be manually interrupted, the distance equivalent of the ball flight in accordance with the magnitude of the ball and hub revolution is displayed by the LCD 76.

The distance display of the LCD 76 permits the operator to determine, by successively using bats of respectively different weights which bat weight is best for him to obtain the greatest ball batted distance measurement.

This batting action is repeated by the operator, as desired and at the end of a batting practice session the operator may close the push button switch S2 to visualize the number of times he has hit the ball.

Obviously the invention is susceptible to changes or alterations without defeating its practicability. Therefore, I do not wish to be confined to the preferred embodiment shown in the drawings and described herein.

I claim:

1. A baseball batting practice apparatus, comprising:

a generally horizontal base;

standard supported by said base, said standard having a series of vertically spaced transverse apertures;

a sleeve slidably surrounding an intermediate portion of said standard and having a transverse aperture for mating with the standard apertures;

means including a pin insertable through said mating apertures for supporting said sleeve at a selected elevation above said base;

a tubular arm horizontally secured at one end to said sleeve and having an end wall opposite said sleeve;

hub means including a cylinder axially journalled by a bolt axially secured to the arm end wall for angular rotation of the cylinder about the longitudinal axis of said arm;

said hub having a planar end face facing the sleeve end wall and having an alternating series of juxtaposed light and dark colored areas on said end face;

a baseball tethered to said cylinder; and, electronic circuit means including trigger inverters, multiplexers, decade counters and liquid crystal diodes connected with a source of electrical energy and supported by said arm and including a sensor nested by said arm end wall adjacent the hub end face and responsive to light reflected by said light colored areas indicating angular revolutions of said hub means for generating a voltage input to said trigger inverters, through the multiplexers and decade counters for visually displaying units of distance measurement by the liquid crystal diodes in direct relationship with the magnitude of force applied to the baseball and the resulting number of angular revolutions of the baseball about the longitudinal axis of the arm.

2. The batting practice apparatus according to claim 1 in which said base is dome-shaped.

3. The batting practice apparatus according to claim 2 in which said base includes an upwardly open socket for nesting the depending end portion of said standard.

4. The batting practice apparatus according to claim 3 in which said standard is tubular.

* * * * *